United States Patent [19]
Baker

[11] 4,402,434
[45] Sep. 6, 1983

[54] FLOW RESPONSIVE CLOSURE DEVICE

[76] Inventor: Richard D. Baker, 3 Robie Rd., Kennebunk Beach, Me. 04045

[21] Appl. No.: 338,597

[22] Filed: Jan. 11, 1982

[51] Int. Cl.[3] ..... B65D 5/72; B65D 35/46
[52] U.S. Cl. ..... 222/492; 222/497
[58] Field of Search ..... 222/492, 493, 496, 497

[56] References Cited

U.S. PATENT DOCUMENTS 1,621,097 3/1927 Zammataro ..... 222/496

FOREIGN PATENT DOCUMENTS 104093 6/1938 Australia ..... 222/492

*Primary Examiner*—David A. Scherbel
*Attorney, Agent, or Firm*—William Nitkin

[57] ABSTRACT

An automatic closure device for containers being openable by pressure on the container and closable when such pressure is released. A cap member having a discharge orifice adapted to be closed by a plug member on a hollow stem is provided. The hollow stem has a discharge port. A diaphragm is positioned on said stem extending out to said cap, and a seal member having an aperture defined therein for receipt of said stem is positioned within said cap forming a pressure chamber between it and the diaphragm. Above the diaphragm which is resilient and movable downwardly by pressure is a discharge chamber. A lock is provided to also lock the plug in an open or in a closed mode.

4 Claims, 2 Drawing Figures

FLOW RESPONSIVE CLOSURE DEVICE

BACKGROUND OF THE INVENTION

1. Field of the Invention

This invention relates to closure means for containers and more particularly to an automatic closure for a deformable container or a container where pressure is otherwise on flowable material therein.

2. Description of the Prior Art

Self-closing automatic closure members for containers such as toothpaste tubes and the like are well-known in the art. Such closures are generally sealed when there is no pressure on the deformable container, but upon pressure being applied to such deformable container, the closure member opens allowing the flowable material contained therein to be discharged. Shampoos, cosmetics, condiments and other products often contained in plastic bottles have been envisioned to use such automatic closure caps. An example of a self-closing closure member is seen in Nilson, U.S. Pat. No. 4,141,474 which discloses containers having diaphragm members upon which pressures to allow the discharge of the flowable material contained therein when pressure is exerted on the containers. Other examples of such self-closures utilize valve members which have movable parts such as disclosed in Laauwe, U.S. Pat. No. 4,057,177 and yet other self-sealing caps for containers utilize the expansion of bellows to unseal the openings for release of the materials within the container such as seen in Testa, U.S. Pat. No. 4,032,051. Some of the devices found in the prior art are extremely complex and costly to produce. An example of such a complex pressure-responsive closure can be found in Feldburg, U.S. Pat. No. 2,607,515. It is to avoid the complexity of the prior art and yet provide a simple and reliable design for an automatic closure that the instant invention was developed.

SUMMARY OF THE INVENTION

It is an object of the present invention to provide an automatic closure unit for containers holding flowable materials which automatic closure will be opened upon pressure being applied and be sealed when such pressure is no longer applied thereto.

It is a further object of this invention for the automatic closure disclosed herein to be adjustable to operate either in an automatic mode, an open mode, or to be locked into a closed mode. The device of the present invention has a cap member with a discharge orifice defined in the top thereof with the inner portion of the discharge orifice of the cap member forming a lip against which a plug member extending from a hollow stem below may engage or be withdrawn therefrom depending upon whether one wishes the cap to be in a closed or open mode. The stem of the plug is hollow and contains therein an annular passage extending therethrough at the base of which is an entry aperture adapted to receive the flowable material held within the container. Near the top of the stem but below the plug's contact point with the lip of the cap is a plurality of discharge ports which allow materials that enter from the entry passage and pass through the annular passage within the hollow stem to exit through the discharge ports into a discharge chamber formed between the cap and the hollow stem member. Extending from a mid-portion of the hollow stem is a surrounding diaphragm member which is resiliently flexible and extends over to contact the circumference of the cap member. This diaphragm completes the discharge chamber forming the base thereof. The stem of the plug member is adapted to pass through a seal member which is positioned within the cap below the diaphragm, and an O-ring type seal means or equivalent is provided between the seal and the hollow stem to prevent the flowable material from passing therebetween yet while allowing the hollow stem to be vertically slidable within the seal member A closed pressure chamber is formed between the diaphragm and the seal member. The diaphragm may extend outward to the cap then downward to the seal member. This closed pressure chamber does not allow any of the flowable material to enter therein. In use when one squeezes the elastically deformable container of the flowable material, such material passes up through the entry aperture at the base of the stem, through the annular passageway and out through the discharge ports and into the discharge chamber. The material then exerts pressure within the discharge chamber including a downward pressure component on the resilient diaphragm which is adapted when there is no pressure to maintain a position holding the plug which is at the top of the hollow stem tightly sealed within the lips of the discharge orifice. Once pressure is put on the diaphragm, the diaphragm is forced downward and the hollow stem attached thereto slides downward within the seal member. As the hollow stem moves downward due to the pressure on the resilient diaphragm, the plug at the top of the stem moves away from the lips of the discharge orifice, and the flowable material escapes therethrough. As long as pressure is maintained on the container, material will escape through the discharge orifice. Once the pressure is released, then the downward pressure on the resilient diaphragm is eliminated and it will resume its normal position causing the hollow stem and plug at the top thereof to rise upwards and reseal the discharge orifice by contacting the lip of the cap member surrounding the plug.

It is a further object of this invention to provide additional elements to the basic system as described above including the provision of a horizontally adjustable cam and a vertical cam with cam followers being an integral part of the cap. The cams are on the outside of the hollow stem below the junction of the lip of the cap and the plug member. When the cap is rotated, such horizontally adjustable cam will cause, by the cam follower riding within the cam, the plug to move either to a closed or to an open position. The plug will remain in either of these positions if so desired. The vertical cam will allow the plug member to move in an automatic mode depending solely on pressure on the container since the cam follower can move vertically to and fro without contact with the vertical cam.

A further element within the system is a key member protruding from the top of the container which is adapted to engage through a corresponding aperture in the seal member a key receipt aperture within a portion of the diaphragm. This key member prevents movement of the seal and diaphragm when the cap is rotated to various positions to adjust the plug in an upwards or downwards position. Further an elongated rotation limiter groove can be provided in the inside of the lower portion of the cap and be adapted to receive a protrusion on the outer portion of the container to mate thereinto, such protrusion being a rotation limiter projection which, when the cap is rotated, travels within the rotation limiter groove, and depending upon the size and length of the rotation limiter groove, determines the amount of rotation of the cap on the container. This rotation limiter will prevent the movement of the cap beyond the limits of the adjustable horizontal cam. The adjustable horizontal cam, of course, can extend completely around the stem so that a complete circular rotation, if the rotation limiter groove and rotation limiter projection are not utilized, will merely move the plug up and down. It is more desirable, however, to have an actual limit so that one could rotate the cap to a position where it stops and one would know that the plug was in its uppermost position and when one rotated it in the opposite direction, one would know that when it stopped, the plug would be in its most open position being furthest away from the lip of the cap member.

DESCRIPTION OF THE PREFERRED EMBODIMENT

Figure 1:
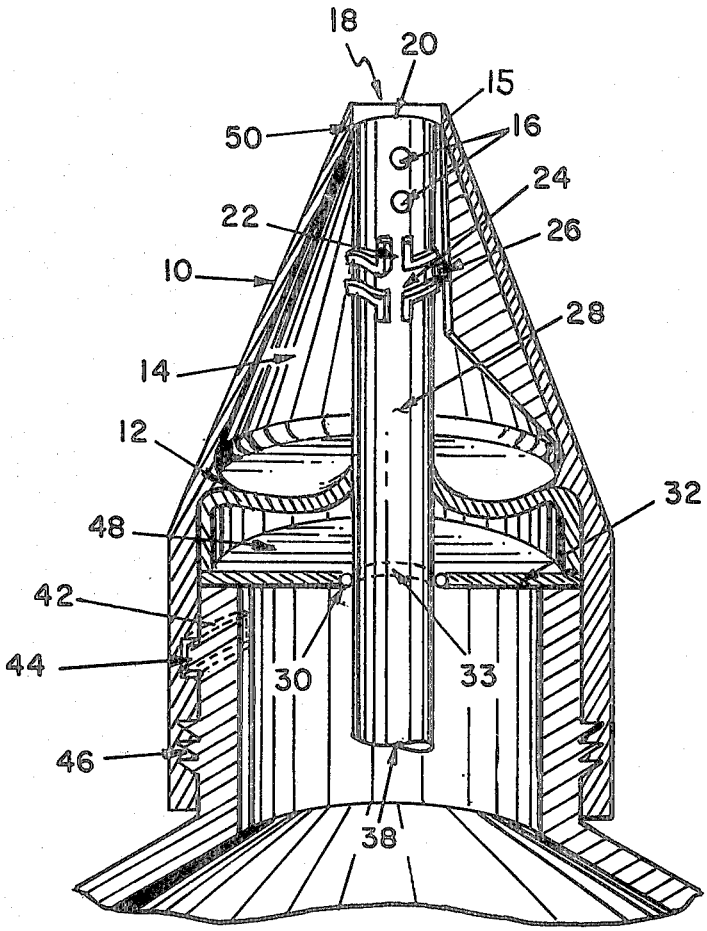
FIG. 1 is a perspective view of the device of this invention with cutaway section.

FIG. 1 illustrates a perspective view of the cap with sections cutaway to disclose the inner workings thereof. Seen in this view is outer cap 10 within which is contained hollow stem 28 having plug 20 being an integral part thereof shown in a closed position contacting lip 50 of cap 10 sealing discharge orifice 18. Seen along the sides of hollow stem 28 are discharge ports 16, and seen in outline form within hollow stem 28 in annular passage 40 and passage entry 38 through which the flowable materials within the container will pass. Positioned midway along hollow stem 28 extending therefrom to cap 10 is diaphragm 12 which is a resilient material but yet deformable by pressure having a memory of its former position so that it may return thereto when the pressure is eliminated. Seal member 32 having stem aperture 33 defined therein is adapted for diaphragm 12 to seal against its outermost portions. Aperture 33 may have seal means 30 such as O-rings or equivalent to contact hollow stem 28 so that it passes therethrough without any fluid leakage from below seal 32 into closed pressure chamber 48 formed between diaphragm 12 and seal 32. Above diaphragm 12 is discharge chamber 14 into which, as has been discussed above, material enters when pressure is exerted, causing the material to pass through entry passage 38 upwards through annular passage 40 and out discharge port 16. Once material enters discharge chamber 14, pressure is exerted on resilient diaphragm 12 and forces hollow stem 28 and plug 20 downward away from lip 15 allowing the escape of the flowable materials through discharge orifice 18. When pressure is released, the resilient diaphragm resumes its former position thereby allowing the hollow stem to move upwards and plug 20 to seal the discharge orifice thereby closing the container. Other types of containers other than deformable ones may be used if pressure is somehow exerted on the contents such as two-piece containers. Also non-pressurable containers may be utilized if only the open/close provision of the cap is utilized.

It is important to note that when pressure is exerted, it is greater in discharge chamber 14 than in closed pressure camber 48 so that the diaphragm is always pushed in a downward position thereby opening the discharge orifice. This increase is due to the surface area of the diaphragm being greater than the surface area of the entry aperture.

Figure 2:
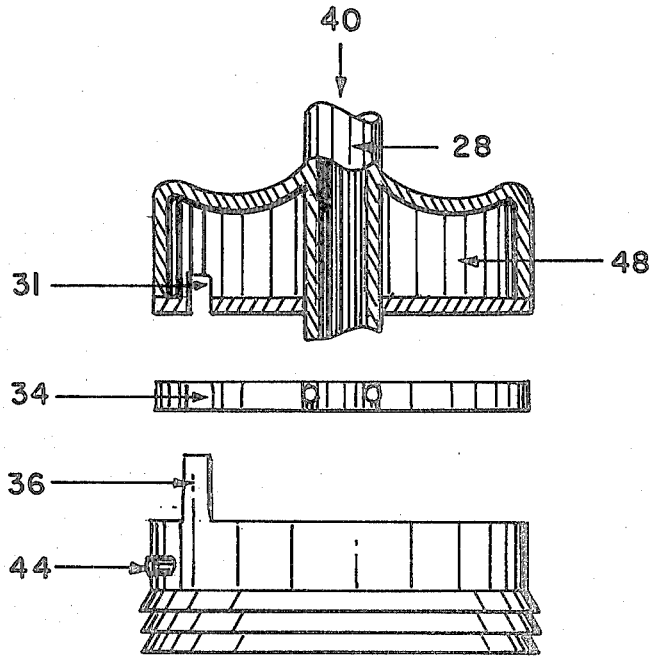
FIG. 2 is a view of the plug and hollow stem with diaphragm thereon illustrating the adjustable horizontal cam and vertical cam; the seal member shown in a position separated therefrom; and the top of a container member shown below illustrating the portions thereof.

In order to either lock the plug in an upward closed position or lock it in an open position, a cam is provided along the inside of hollow stem 28. A vertical cam 22 is provided with a cam follower 26 which is affixed to cap 10 which follows within the members of the vertical cam and allows the plug to move up and down freely when cam follower 26 is aligned with vertical cam 22. When one wishes to lock the plug in an upward position, one rotates the cap and the cam follower then passes inbetween the members of the adjustable horizontal cam 24 as can be seen in FIG. 2. This movement will move the plug member either upwards or downwards thereby either opening or closing the discharge orifice depending upon the direction of rotation. It has been found desirable that the stem not rotate when the cap rotates which might otherwise prevent the proper operation of such opening and closing. For this purpose key member 36 is provided on container 37 which passes through keyway 34 in the seal in a fluid-tight relation and into a key receipt aperture 31 defined within the diaphragm also in a fluid-tight relationship thereby preventing rotation of the plug when the cap member is rotated. In order to limit the rotation of the cap member, a rotation limiter groove 42 is provided in the inside portion of the cap with a corresponding rotation limiter projection 44 seen also in FIG. 2, which will travel horizontally within the rotation limiter groove 42 as the cap is rotated causing a stoppage of the rotation at an end point when limiter 44 hits the end of the groove which would correspond to either the high point or low point of the movement of plug 20 up and down. Indicia can be placed outside the cap to indicate the open and closed mode positions.

Normal threads on a bottle could be utilized but in the embodiment illustrated, the threads are not screw threads but are rotation threads allowing for the cap to be inserted by pushing it over the container and engaging its threads into mating threads so that the rotation of the cap will not unscrew it but will rotate evenly thereon.

Although the present invention has been described with reference to particular embodiments, it will be apparent to those skilled in the art that variations and modifications can be substituted therefor without departing from the principles and spirit of the invention.

I claim:

1. An improved automatic closure device for containers containing flowable material, comprising:

a cap member including means to engage said container having a discharge orifice defined within a portion thereof;

a hollow stem member having a plug at the top thereof adapted to plug said discharge orifice, said stem member having at least one discharge port defined therein in a side thereof;

a resilient diaphragm integral with said hollow stem member adapted to extend over and contact said cap member;

a seal member having an aperture defined therein adapted for said hollow stem member to be fluid-tight and vertically slidable therein and pass therethrough, adapted to form a pressure chamber between itself and said diaphragm member;

a discharge chamber formed above said resilient diaphragm between it and said cap member, said closure device adapted so that when pressure is applied, said flowable material passes into said hollow stem and out said discharge ports and into the discharge chamber thereby applying pressure to the resilient diaphragm which is adapted to then move downward, the pressure being greater in the discharge chamber than in the pressure chamber on the othere side of said diaphragm allowing the escape of said flowable materials through said discharge orifice and upon the release of said pressure, said resilient diaphragm being adapted to return to its original position, causing said hollow stem and the plug at the top thereof to move upward and reseal said discharge orifice by contacting said cap member; and further including means for holding open and holding closed said cap member without material pressure on said diaphragm.

2. The device of claim 1 wherein said means for holding open and holding closed said cap member comprise the providing of an adjustable horizontal cam and a vertical cam on said hollow stem and a cam follower upon the inside of said cap member adapted to engage into either the adjustable horizontal cam or the vertical cam depending on the rotated position of said cap being further adapted so that if said cap is rotated, said cam follower will cause the stem to either move to a downward open position or to an upward closed position or be in a position to be aligned with the vertical cam member wherein the hollow stem will move downwards only upon the exertion of pressure on the diaphragm.

3. The device of claim 2 further including:

a key member positioned upon said container;

a keyway defined within said seal member; and a key receipt aperture defined within said resilient diaphragm, said keyway and key receipt aperture adapted to receive said key when assembled to prevent the rotation of said diaphragm member in relation to said cap.

4. The device of claim 3 further including a rotation limiter groove defined on the inside of said cap and a rotation limiter projection positioned on the outside of said container adapted to engage said groove to limit said rotation of the cap to the limits of the lateral movement of the rotation limiter projection within the rotation limiter groove.

* * * * *